US006167684B1

(12) United States Patent
Perrone

(10) Patent No.: US 6,167,684 B1
(45) Date of Patent: Jan. 2, 2001

(54) FEEDING MECHANISM FOR MACHINE FOR ENROBING TABLETS

(76) Inventor: Aldo Perrone, 7050 A Bramalea Road, Unit 19, Mississauga, Ontario (CA), L5S 1T1

( * ) Notice: Under 35 U.S.C. 154(b), the term of this patent shall be extended for 0 days.

(21) Appl. No.: 09/240,730

(22) Filed: Jan. 29, 1999

(51) Int. Cl.[7] ..... B65B 47/00
(52) U.S. Cl. ..... 53/560; 53/559
(58) Field of Search ..... 53/560, 559, 454, 53/453, 900

(56) References Cited

U.S. PATENT DOCUMENTS

| | | | | |
|---|---|---|---|---|
| 1,481,866 | * | 1/1924 | Heist | 53/454 X |
| 2,513,852 | | 7/1950 | Donofrio | 53/560 X |
| 2,697,317 | | 12/1954 | Stirn et al. | 53/454 X |
| 2,775,080 | | 12/1956 | Stirn et al. | 53/454 X |
| 2,775,081 | | 12/1956 | Stirn et al. | 53/454 X |
| 3,759,011 | * | 9/1973 | Akke | 53/560 X |
| 4,567,714 | | 2/1986 | Chasman | 53/438 |
| 4,940,499 | * | 7/1990 | Lebrun et al. | 53/900 X |
| 5,074,102 | | 12/1991 | Simpson et al. | 53/454 |
| 5,146,730 | | 9/1992 | Sadek et al. | 53/454 |
| 5,329,749 | * | 7/1994 | Yamamoto et al. | 53/900 X |
| 5,538,125 | | 7/1996 | Berta | 198/345.3 |
| 5,607,044 | | 3/1997 | Berta | 198/468.4 |
| 5,682,733 | | 11/1997 | Perrone | 53/560 |

FOREIGN PATENT DOCUMENTS 881022 11/1961 (GB) .

OTHER PUBLICATIONS

Wolke, J. Elmer, "One–Piece Hard Gelatin Capsules—New Option For Pharmaceutical and Food Applications," *packaging technology*, Mar./Apr. 1987, vol. 17, No. 2, pp. 4, 7 and 16.

* cited by examiner

*Primary Examiner*—Eugene Kim
(74) *Attorney, Agent, or Firm*—Barry R. Lipsitz

(57) ABSTRACT

A feeding apparatus for delivering tablets or performs to an encapsulating machine includes a number of vertically extending chutes, each capable of holding a number of tablets aligned in a row along the respective chute. A plunger mechanism temporary engages one of the tablets in the chute so as to prevent downward movement of the tablet and all pills located above it in the chute. A rotatable feed roll is located adjacent a bottom end section of the chutes and this roll has a number of tablet cavities, each capable of holding an individual tablet. Pivotable stop members are used to prevent temporarily downward movement of the bottom pill in each chute, this pill being located downstream of the plunger. These stop members move to a pill releasing position when the plungers are engaging their respective tablets in the chutes. Each stop member prevents downward movement of its respective row of pills in the chute past the stop member when the plunger is moved to a position of disengagement.

21 Claims, 6 Drawing Sheets

FEEDING MECHANISM FOR MACHINE FOR ENROBING TABLETS

BACKGROUND OF THE INVENTION

This invention relates to tablet or preform feeding apparatus for delivering tablets or preforms to a processing machine, in particular, to a machine for encapsulating or covering the tablets and preforms.

Over the years, a number of machines have been developed for forming and processing tablets or preforms. Incomplete pills or tablets can be moved along a suitable chute or passageway for further processing or completion. A well known final step in the production of many pharmaceutical pills is that of encapsulating or covering the pills with a layer of a protective material such as soft gelatin. This gelatin may be delivered to an encapsulating machine in the form of a strip formed on a casting drum.

One well known machine for encapsulating medicine tablets is taught in recent U.S. Pat. No. 5,146,730 issued Sep. 15, 1992 to Banner Gelatin Products Corp. In this patent specification, several possible ways for feeding tablets or preforms to a machine for encapsulating these tablets in a gelatin layer are shown and described. According to one preferred apparatus, the tablets are fed to a nip of two rotary dies by means of a vertical passageway extending through the centre of a core feed horn that extends into the region of the nip. An alternative method shown in this patent specification for feeding preforms to the rotary dies involves the use of a plurality of preform magazines formed in a downwardly extending strip of material, these magazines metering preforms to respective recesses in a rotary preform transfer device. The latter device in turn moves individual preforms to an adjacent surface of a gelatin film and places the preforms on this surface in places on the film corresponding to respective die recesses.

In a more recent U.S. Pat. No. 5,682,733 issued Nov. 4, 1997 to the present applicant, there is described another preform feeding apparatus wherein preforms are fed in separate rows down sloping chutes. There is a timing device for releasing one whole tablet or preform at a time from each chute. A mechanism for dropping individual whole tablets onto the gelatin web is connected to the bottom ends of the chutes. It has a tablet supporting bottom in the form of a flat plate having one aperture for each of the chutes. The apertures are sized to permit a single tablet or preform to drop through each. The dropping mechanism includes a sliding feed member and a drive device capable of sliding this member at timed intervals in a direction transverse to the moving gelatin web.

In applicant's co-pending U.S. patent application Ser. No. 09/059,144 filed Apr. 13, 1998 entitled "MACHINE FOR ENROBING TABLETS WITH GELATIN", another feeding system for transferring tablets or preforms from vertically extending chutes to the surface of a moving gelatin web is taught. In this tablet dispensing mechanism, vacuum applying members are used to pick up individual tablets located at the bottom ends of the chutes. Each vacuum applying member is mounted to a plenum chamber that is evacuated by a vacuum line. The vacuum applying members can be moved both vertically and horizontally in order to transfer individual tablets to the moving gelatin web which, at this stage, is located on a rotating sealing die roll. The disclosure of this pending U.S. application is hereby incorporated herein by reference.

It is an object of the present invention to provide a feeding apparatus for delivering tablets or preforms to a processing machine, which is reliable and which can transfer the tablets or preforms rapidly, thereby permitting the tablets or preforms to be processed quickly.

It is a further object of the present invention to provide an efficient feeding apparatus for delivering tablets or preforms to a moving web of material such as gelatin, this apparatus including a vertically extending chute and a rotatable feed roll located adjacent a bottom end section of the chute, as well as a timed tablet holding and releasing mechanism capable of releasing a single tablet in the chute so that it can descend by force of gravity to the feed roll.

SUMMARY OF THE INVENTION

According to one aspect of the invention, a tablet feeding apparatus for use in the manufacture of pills includes a chute adapted to hold and transfer a row of tablets arranged along the chute, this chute extending vertically during use thereof. A rotatable feed roll is capable of moving the tablets from a bottom end of the chute onto a top surface of a single moving web of material. This feed roll is located adjacent a bottom end section of the chute and has a number of tablet cavities each capable of holding an individual tablet. The cavities are distributed about the circumference of the feed roll. A timed tablet holding and releasing mechanism capable of releasing a bottom tablet in the chute so that it can descend by force of gravity into an empty one of the cavities is also provided. This mechanism holds back other tablets in the chute and includes a movable holding member for temporarily preventing all tablets located in the bottom tablet in the chute from descending in the chute when the bottom tablet is released.

Preferably the feed roll is coated with tetrafluoroethylene polymer (Trade Mark—Teflon).

According to a further aspect of the invention, a feeding apparatus for delivering pills and the like to a machine for encapsulating or covering the pills in a layer of protective material, such as gelatin, includes at least one elongate pill chute with each chute capable of holding a number of pills aligned in a row along the respective chutes and capable of feeding the pills by force of gravity to a moving web of the protective material. A plunger mechanism capable of temporarily engaging one of the pills into each chute is also provided. This mechanism prevents downward movement of the pill and all pills located above it in the respective chute. The apparatus includes a rotatable feed roll with a circular circumference located adjacent a bottom end section of the at least one pill chute. The feed roll has a number of pill cavities each capable of holding an individual pill and these cavities are distributed around the circumference of the feed roll. In addition, there is a stop mechanism for preventing temporarily downward movement of a bottom pill of the row of pills in the or each chute, this bottom pill being located downstream of the plunger mechanism. The stop mechanism moves to a pill releasing position when the plunger mechanism is engaging one of the pills in the respective chute, the engaged pill being located directly above the bottom pill in the chute, and when the feed roll has rotated to a position where it can receive the bottom pill in an empty one of the cavities. The stop mechanism prevents downward movement of the row of pills in the or each chute past the stop mechanism when the plunger mechanism is moved to a position of disengagement from any pill in the chute or chutes.

In the preferred apparatus, there are a number of pill chutes arranged in side-by-side fashion and extending downwardly at a steep angle to the horizontal plane. Preferably the feed roll is generally cylindrical in shape and has a number of circumferential rows of pill cavities.

According to still another aspect of the invention, a tablet feeding apparatus for delivering tablets to the moving web of a covering material such as gelatin, includes two or more chutes, each sized to hold and transfer a number of tablets arranged in a row along the chute by force of gravity. The chutes extend vertically during use thereof. A contact mechanism is used to temporarily engage one of the tablets in each chute so as to prevent downward movement of the one tablet and all tablets located above this one tablet in the respective chute. A rotatable feed roll is located adjacent the bottom end section of the chutes, this feed roll having a number of tablet cavities, each capable of holding an individual tablet. The cavities are distributed around the circumference of the feed roll and form one circumferential row of cavities for each chute. A movable stop member for each of the chutes provides a timed release of a bottom tablet in the respective chute, this bottom tablet being located downstream of the contact mechanism. Each stop member is moved to a stopping position when the contact mechanism is disengaged from any tablet in its respective chute and is moved to a releasing position when the contact mechanism is engaging the one tablet in its respective chute. A drive device is capable of moving each stop member between the stopping position and the releasing position in a timed manner so that each bottom tablet is only released when the feed roll has rotated to a position where it can receive the bottom pill in an empty one of the cavities.

In one preferred embodiment, the contact mechanism includes two or more plungers, one for each of the chutes, and an air pressure operated drive mechanism for moving the plungers from the tablet engaging position to a retracted position of non-engagement.

Further features and advantages will become apparent from the following detailed description taken in conjunction with the accompanying drawings.

DETAILED DESCRIPTION OF PREFERRED EMBODIMENT

Figure 1:
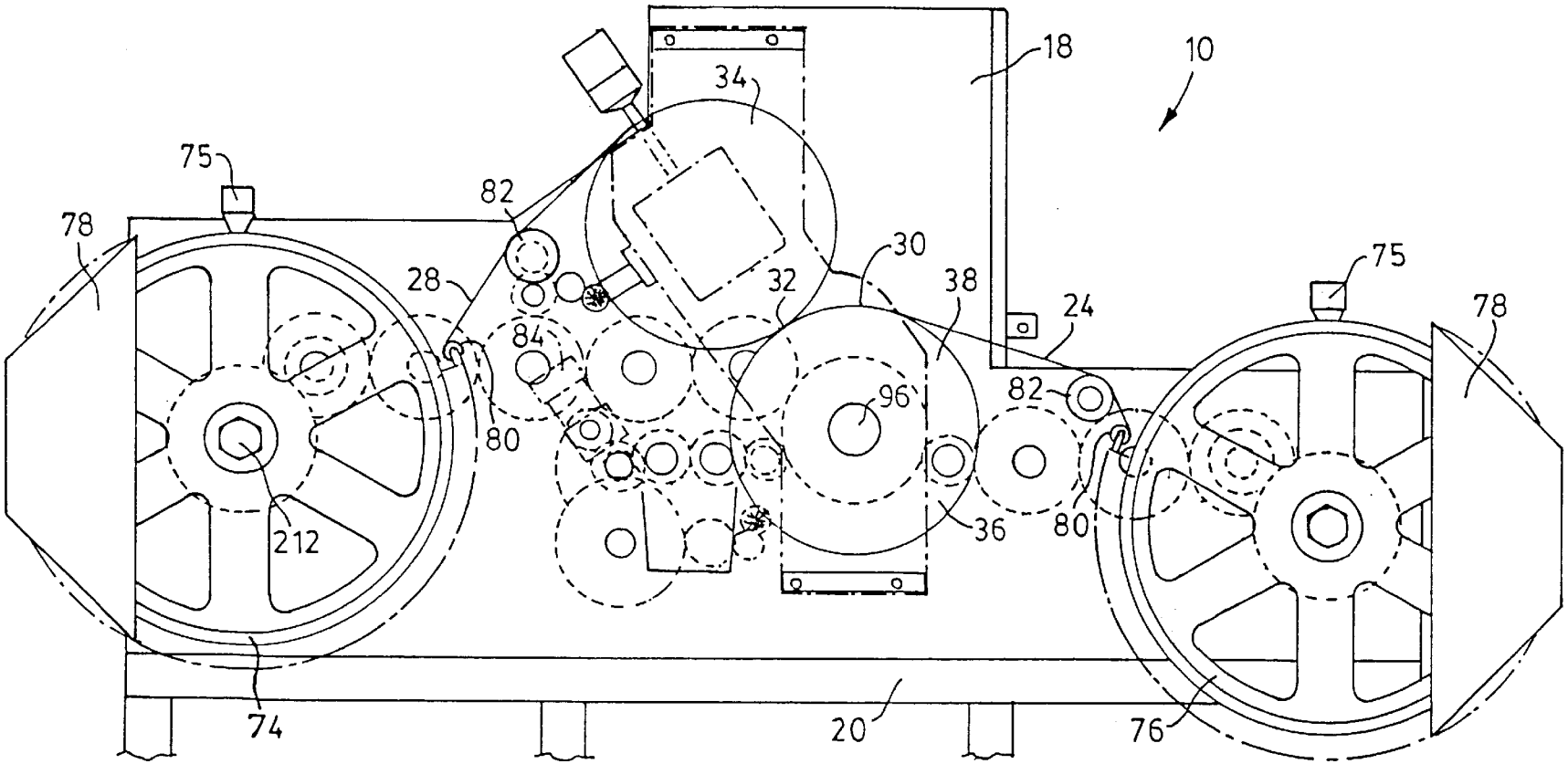
FIG. 1 is a front elevation of an apparatus for enrobing tablets constructed in accordance with the invention, a front cover plate being shown in dot-dashed line and the tablet feeding mechanism of the invention being omitted from this view.
Figure 2:
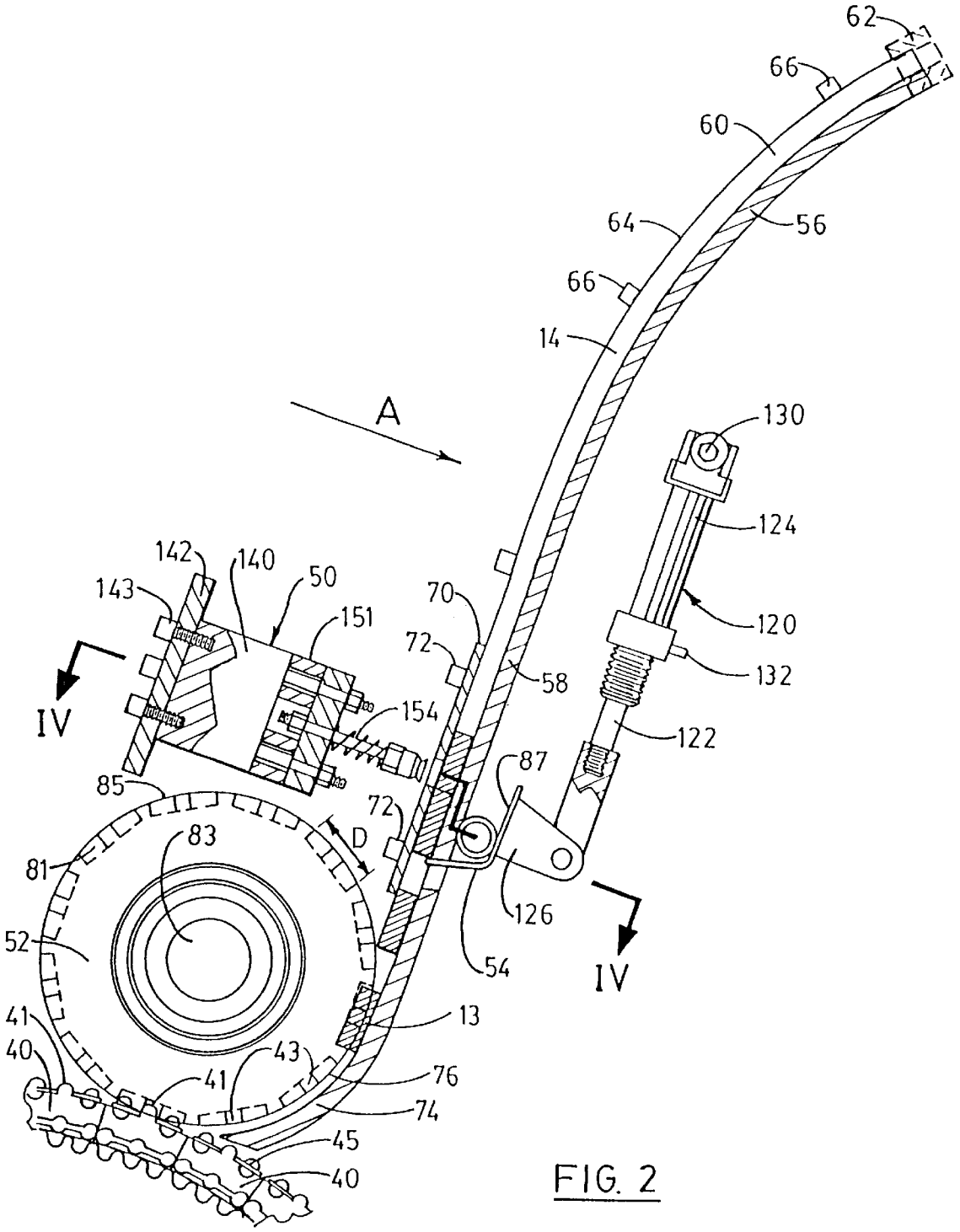
FIG. 2 is a side elevation of a feeding apparatus constructed in accordance with the invention, this view showing cavities formed in a rotatable feed roll in dash lines and showing the chute member in cross-section taken along a vertical plane.

FIG. 1 illustrates a tablet enrobing apparatus 10 with which the tablet feeding apparatus of the invention can be used. The preferred form of feeding apparatus is shown in FIG. 2 of the drawings. The apparatus 10 is capable of enrobing medicine or similar ingestible tablets in a layer of gelatin, one of these tablets or preforms being indicated at 13 in FIG. 2. Not shown in FIGS. 1 and 2 but attached to the upper end of the feeding apparatus is a standard bowl feeder of known construction, this feeder acting to provide properly oriented tablets to vertically extending chutes 14 which are a major part of the feeding apparatus.

A rigid base structure 20 supports the apparatus 10 on a floor or other suitable horizontal surface and only part of this structure is illustrated. The apparatus 10 can be used to enrobe the tablets 13 with a gelatin coating made from two webs or films of gelatin indicated at 24 and 28. Individual preforms or tablets are dispensed onto the gelatin strip 24 at a feeding location indicated at 30 which, in a particularly preferred embodiment, is approximately where the gelatin web 24 is applied to a lower of two cylindrical rotary die assemblies indicated at 34 and 36. Two gelatin strips 24, 28 are brought together at the nip 32. The die assemblies each include a substantially cylindrical, rotatable die support 38 and a series of die blocks 40, a few of which are shown in FIG. 2. The die blocks are mounted on the die support for rotation about a central axis of the die support 38. The apparatus 10 (not including the feeding apparatus of the present invention), the rotary die assemblies 34 and 36 and the die blocks are illustrated and described in detail in applicant's co-pending U.S. application Ser. No. 09/059,144 filed Apr. 13, 1998, the disclosure of which is incorporated herein by reference. Each of the die blocks 40 can be of identical construction and they are preferably made of a durable, tough, hard plastics material using an injection molding process.

Each of the preferred die blocks 40 has a number of recesses formed in a top surface thereof. With the illustrated feeding apparatus which has eight tablet chutes, there are eight of these spaced apart recesses formed in the top of each die block. Each recess is dimensioned to receive loosely therein one of the tablets 13. The recesses can be substantially oval in shape in order to accommodate tablets of this shape, but it will be understood that other shapes, for example, round, are also possible depending upon the shape of the tablets for which the apparatus is designed. Slots or holes (not shown) can be provided in the bottom of these recesses in order to permit the escape of air during the tablet encapsulating process. The blocks are connected to one another by means of rings that extend about the circumference of each rotary die assembly on both sides thereof.

A raised rim 45 extends about the perimeter of each recess for cutting the gelatin web or strip 24 after it is laid over the top of the block and is pulled into the nip. Preferably this rim has a width from one to two times the thickness of the gelatin web. The height of the rim should be more than the thickness of the gelatin web 24.

As shown in FIG. 1, there are mechanisms at opposite ends of the apparatus 10 for delivering gelatin strips 24, 28 to each of the die rotating assemblies 24, 36. The webs are cast on separate, rotating casting drums which per se are of known construction. These drums 74, 76 which are made of stainless steel, have gelatin delivered to them in a liquid state through heated hoses. The gel passes through these hoses to spreader boxes 75, one at the top of each casting drum. The liquid gel is spread onto the drum which rotates and forms the gel into a ribbon or strip. A fan blower 78 can be provided on each drum and acts to cool the gelatin so that it is changed into a solid strip which can be peeled from the drum by an adjustable roller 80. The thickness of the gel strip can range from 10 to 30/1000ths of an inch. Each gel strip passes over a rotating oil roller 82 which applies a thin layer of oil on the outside surface. The gelatin web 24 then extends to the lower die assembly 36 where it is laid on the die blocks. The web 28 extends to the upper die assembly 34 where it is placed over rotating die blocks extending across the top of this die assembly. After the two webs pass through the nip they are adhered to each other and, in this state, they are pulled down through a scrap ribbon puller 84.

A drive system is provided for rotating both die assemblies 34,36 about their respective central axes so that the two series of blocks move in synchronism with each other. This drive system is described in detail in the aforementioned pending U.S. patent application. An output shaft of a drive motor is connected to a main drive shaft 96 which is rotatably mounted in a rear support plate (not shown).

Turning now to the feeding apparatus 12 for delivering tablets, pills, preforms and the like to the tablet enrobing apparatus 10, this apparatus includes several basic components including at least one elongate pill chute 14 capable of holding a number of pills or tablets aligned in a row along the chute, a plunger mechanism indicated generally at 50, a rotatable feed roll 52, with a circular circumference and stop means for preventing temporarily downward movement of a bottom pill of the row of pills in the chute. The stop means 54 is located just downstream of the plunger mechanism and is movable to a pill releasing position when the plunger mechanism is engaging one of the pills in the chute. This engaged pill is located directly above a bottom pill in the chute. For purposes of the present application, the "bottom pill" of the row of pills in each chute is considered to be the pill currently engaged by the stop means 54 and does not include any pill which may have been released by the stop means into the rotatable feed roll 52.

Figure 3:
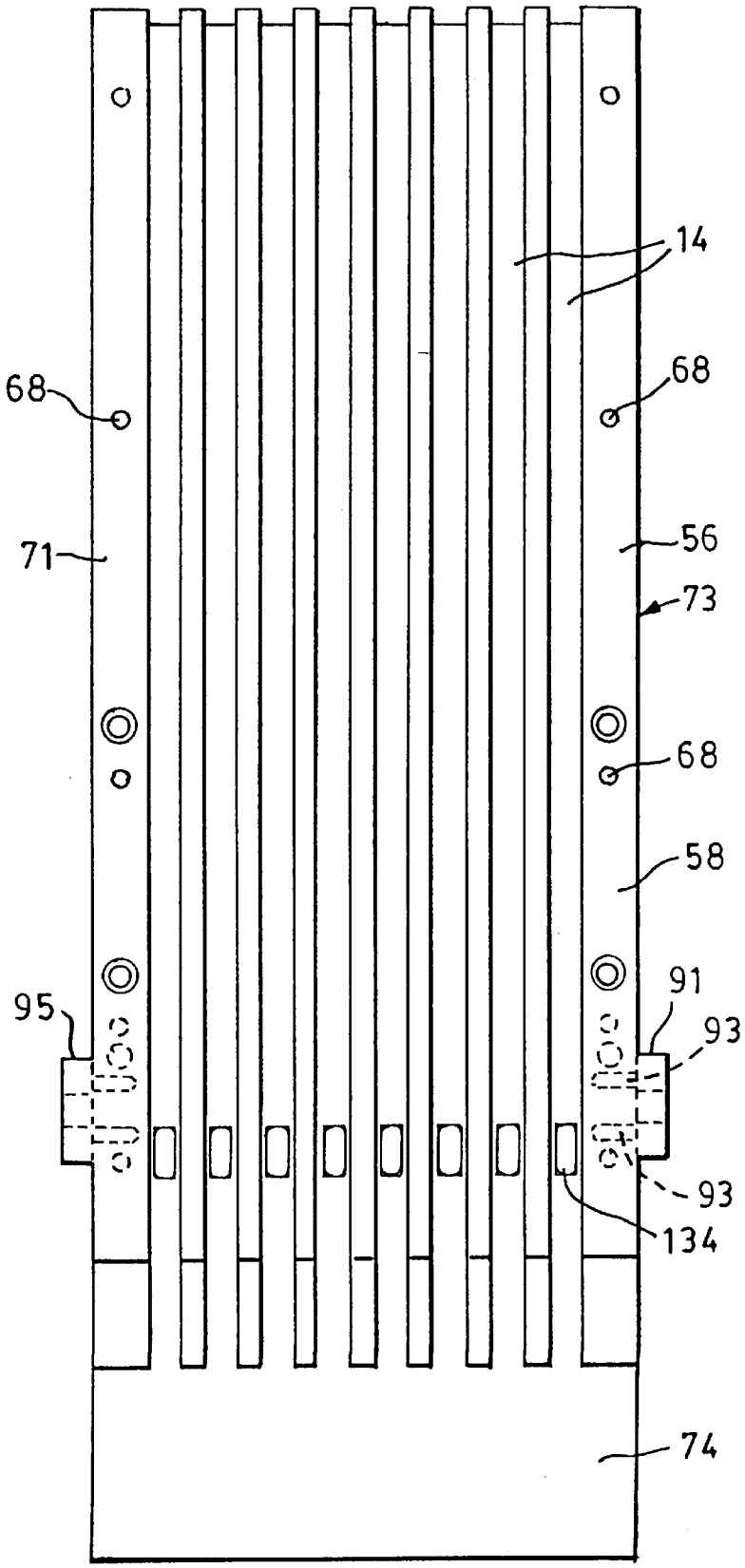
FIG. 3 is a front view of the vertically extending chutes that are part of the feeding apparatus, this view being taken in the direction of the arrow A shown in FIG. 2.
Figure 4:
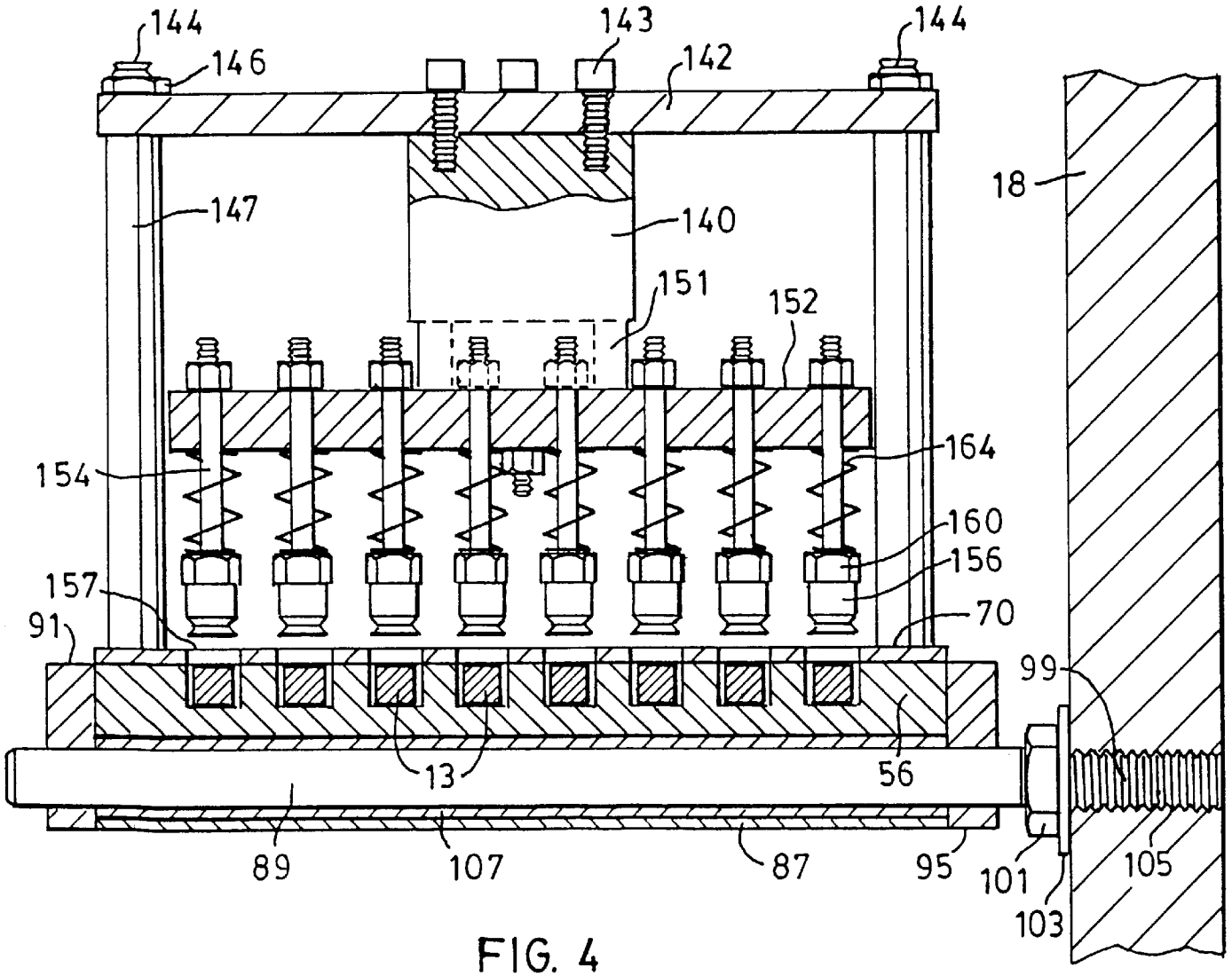
FIG. 4 is a cross-sectional view of the chutes, a transversely extending pivot shaft, and the plunger mechanism, this view being taken along the line IV—IV of FIG. 2.

The preferred construction of the chutes 14 will now be described with references to FIGS. 2 and 3. Preferably there are a number of chutes 14 arranged in side-by-side fashion. In the embodiments shown in FIG. 3 there are eight chutes of the same size and length. These chutes are formed by an elongate, metal chute member 56 which has a straight section 58 and an upper curved section 60. A connecting bracket 62 extending substantially the width of the chute member can be provided at its top end for attaching the chute member to the output end of the aforementioned bowl feeder which delivers the aligned tablets to all of the chutes. The chutes 14 can comprise elongate grooves formed in the upper or front surface of the chute member and it will be understood that the width of these grooves is slightly greater than the width of the tablets that descend along these grooves. In this way, the tablets are maintained in proper alignment and orientation and are maintained in a single row for feeding to the tablet enrobing machine. Preferably the tops of the grooves are covered with a flexible plastic sheet indicated at 64. This sheet which is preferably transparent so that the tablets can be seen is attached along its edges by means of a number of bolts 66. Only the holes 68 for these bolts are shown in FIG. 3. The bottom end of the sheet 64 is located along the top edge of a flat, metal plate 70.

The plate 70 is attached to the edge sections 71 and 73 of the chute member by means of bolts 72. The plate 70 is used to mount the aforementioned plunger mechanisms 50 described below. At the bottom end of the chute member 56 is a bottom end section 74 that forms an arc which is concave upwardly, this is closely following a circumferential section 76 of the feed roll 52. This bottom end section ensures that the tablets dropped into the feed roll 52 are held in the pill or tablet cavities 81 that are distributed around the circumference of the feed roll 52. It will also be noted that the bottom end of the chute member 56 is located close to the gelatin web that lies on the blocks 40.

The feed roll 52 is fixedly mounted on a rotatable, horizontal shaft 83. This shaft can be rotatably mounted by means of suitable bearings (not shown) in the vertical support plate 18 which is rigidly attached to the base structure 20. The feed roll 52, which can be made of aluminum, is preferably coated with a thin layer of Teflon (trade mark) indicated at 85. The Teflon covers the entire circumferential area of the feed roll, including the walls of the cavities 81 and the bottoms of these cavities and the surface areas surrounding the cavities. It can also cover even the two ends of the roll, if desired. The preferred form of Teflon is referred to as pharmaceutical grade Teflon.

It will be appreciated that each of the cavities 81 formed in the feed roll is capable of holding an individual tablet or pill and these cavities are evenly distributed about the circumference of the feed roll as shown in FIG. 2. The pill cavities are of uniform size and each has a circumferential dimension indicated at D in FIG. 2 that corresponds closely to one dimension, preferably the length, of the pill or tablet to be encapsulated. Similarly, each pill cavity 81 has an axial dimension (measured in the direction of the center axis of the shaft 83) corresponding closely to another dimension of the pill or tablet, preferably the width thereof. The fit of the pill in each direction should be a loose fit, i.e. 20/1000ths of an inch total gap in each direction. Also, as indicated in FIG. 2, each pill cavity 81 has a depth as measured at opposite ends of the cavity which is approximately the same as one half of the depth of each pill or tablet to be encapsulated. It will be appreciated that the cavities 81 are arranged in circumferential rows with one circumferential row of cavities being provided for each of the chutes 14. Thus, in the illustrated embodiment of FIGS. 2 and 3, there are eight circumferential rows of these cavities aligned with the eight chutes 14. It is advisable for each cavity 81 to have a depth at least equal to one half the depth of each pill but the depth of the cavity can be greater.

There is a drive mechanism for rotating the feed roll 52 preferably on a continuous basis during the operation of the machine 10. It will be appreciated that the rotary die assemblies 34 and 36 and the blocks 40 are rotated on a continuous basis in order to enrobe tablets or preforms in the gelatin webs 24 and 28 and accordingly the feeding apparatus generally must operate on a continuous basis as well. However, it is possible that for some tablet feeding operations continuous operation may either not be required or may not be desirable and it is possible that the feeding apparatus of the invention could be operated on a timed intermittent basis if required for the manufacturing process.

The preferred illustrated drive mechanism for the feed roll is provided by a series of evenly spaced bumps or rounded teeth 41 formed on top edges of the blocks 40 and interengaging edge recesses 43 formed on one end of the feed roll 52 about its circumference. Thus rotation of the rotary die assemblies causes a corresponding rotation of the feed roll. This ensures that the cavities 81 are always correctly positioned.

The stop mechanism for preventing temporarily downward movement of the bottom pill now will be described with particular reference to FIGS. 4 to 9. The principal component of this stop mechanism is a pivotable stop device 87 which is shown separately in FIGS. 5 to 8. This stop device 87 is pivotable about a shaft or pin 89 shown in FIG. 4. At the outer end this shaft is rotatably supported by means of shaft support 91 which can be detachably connected by means of screws or bolts to one side of the chute member 56. The screws (not shown) are secured in threaded holes indicated at 93. A similar shaft support 95 is provided on the opposite side of the chute member and it also is connected to the side of the chute member by two screws or bolts. The shaft or pin 89 is further supported by the aforementioned support wall 18. An end section of the shaft 89 can be threaded at 99 and a nut 101 threaded onto the end of the shaft. This nut rests against a washer 103. It will be appreciated that by adjusting the position of the nut 101, the horizontal position of the bottom end section of the chute member 56 can be adjusted. The shaft 89 is secured in a threaded hole 105 formed in the support wall 18. A friction reducing bushing 107 can be provided between the stop device 87 and the shaft 89.

Figure 5:
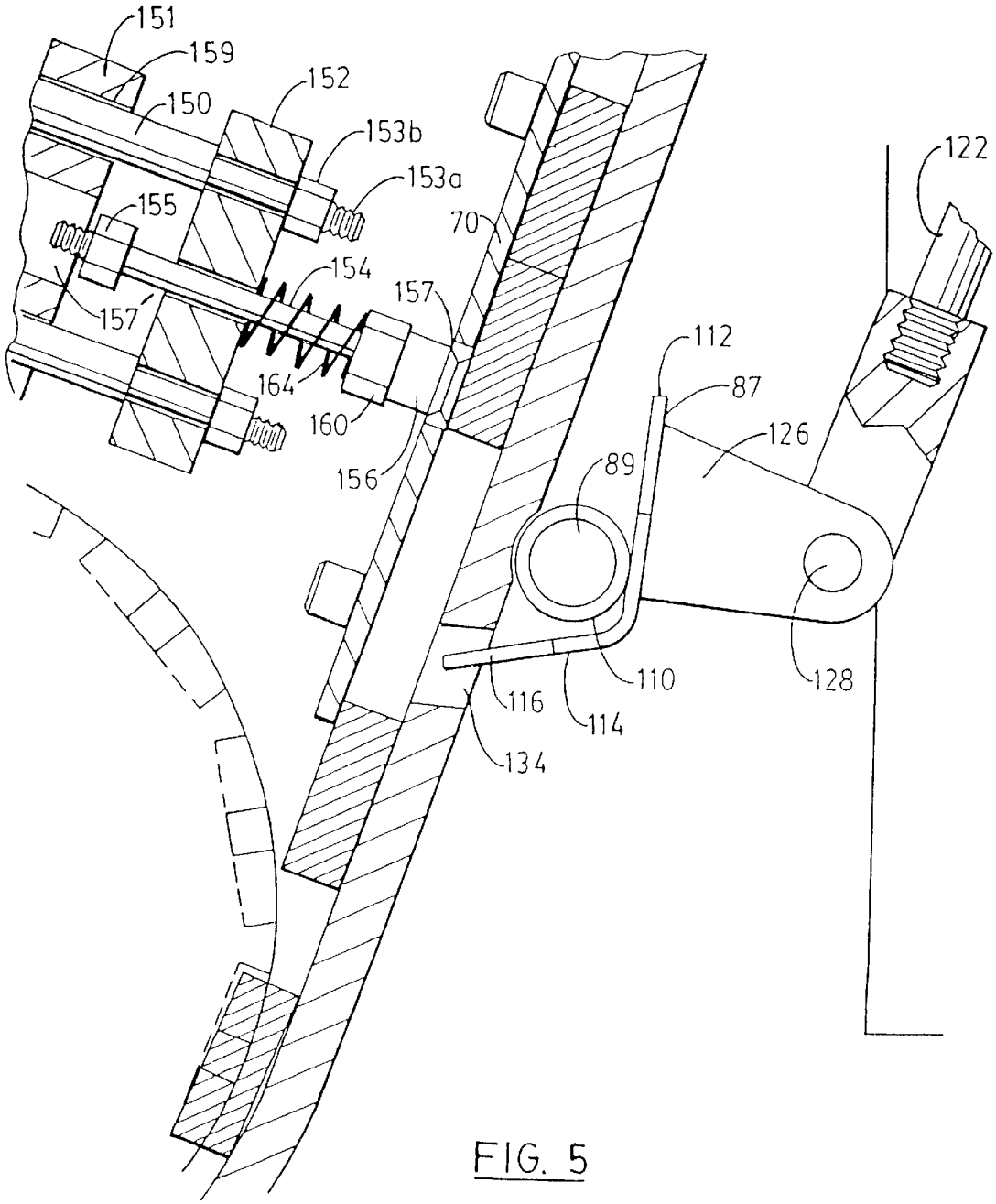
FIG. 5 is a detail cross-sectional view showing a plunger engaging a tablet and a stop member pivoted to a releasing position.
Figure 6:
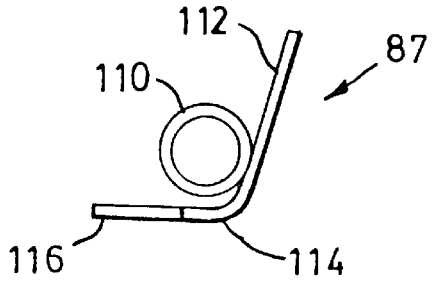
FIG. 6 is an end view of the pivotable stop member mounted on the shaft shown in FIG. 4.
Figure 7:
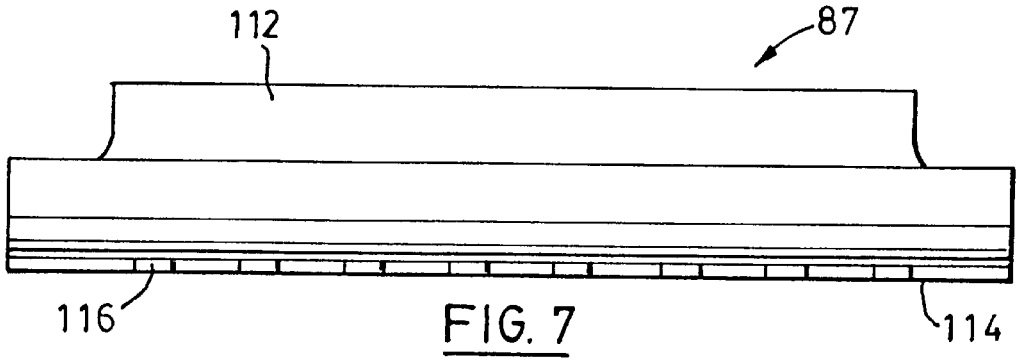
FIG. 7 is a front elevation of the stop member of FIG. 6.
Figure 8:
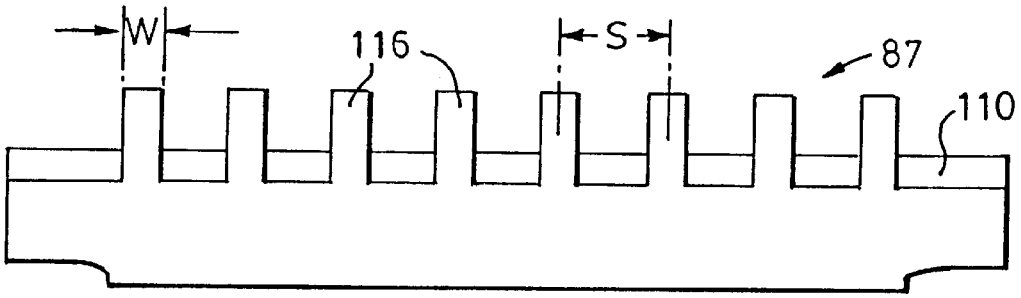
FIG. 8 is a bottom view of the stop member of FIG. 6 showing the eight stop fingers of this preferred embodiment.
Figure 9:
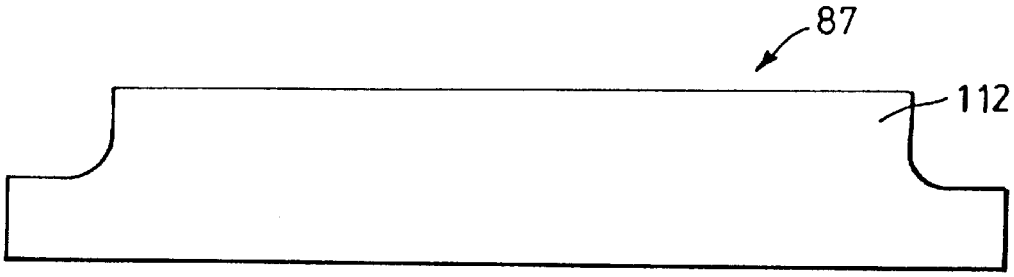
FIG. 9 is a rear elevation of the stop member of FIG. 6.

Turning now to the preferred construction of the stop device 87 as shown in FIGS. 5 to 9, this device has a tubular section 110 through which the shaft 89 extends. Projecting upwardly from a rear side of this tubular section is a wide lever arm 112. A finger forming section 114 extends horizontally from the bottom of the tubular section 110 as shown in FIG. 6. This section 114 has a number of spaced apart fingers 116 arranged in a row in a side-by-side manner. These fingers can be pivoted from a movement preventing position shown in FIG. 2, where each finger 116 projects into a respective one of the chutes 14, to a pill releasing position shown in FIG. 5 where the fingers are located away from the paths of movement of the pills or tablets down and along the chutes. The fingers 116 can also be considered stop members which are moved to a stopping position when the aforementioned plunger mechanism 50 is disengaged from any tablet in its respective chute.

There is a drive mechanism or means for pivoting the stop device or member 87 in a timed manner between the stop position where the fingers or stop members extend into their respective chutes and the release position where the fingers or stop members are moved out of the chutes. The preferred drive mechanism is illustrated in FIG. 2 and comprises an air pressure operated piston and cylinder drive device indicated generally at 120. The device 120 has a piston member 122 with a piston at its inner end slidably movable in a cylinder 124 of the drive device. An outer end of piston member is connected by means of a connecting lug 126 to the pivotable stop device 87 and in particular to the lever arm 112. A pivot pin connection is provided at 128. In addition, the upper end of the cylinder 124 is pivotably connected by a horizontal pivot pin support 130 which can be mounted in the aforementioned machine support plate 18. It will also be appreciated that the air cylinder 124 is connected to a source of pressurized air by an air pressure hose (not shown) which can be connected to air connection 132. The operation of the air cylinder can be controlled by a suitably programmed microprocessor of standard design.

A series of holes 134 are formed in the bottom of the chutes 14 and through these holes the fingers 116 are able to project when the stop device 87 is in the position shown in FIG. 2. In particular, the fingers 116 project a sufficient distance into the chute to prevent downward movement of the bottom pill of the row of pills in the chute (not including any pill that has already dropped down past the stop device to the feed roll). In order to release the bottom pill, it is simply necessary for the piston member 122 to be retracted a short distance, thereby pivoting the stop device 87 and its fingers counterclockwise. When the stop device is pivoted in this manner, the fingers are located away from the path of movement of the pills or tablets down and along the chutes 14.

In a preferred embodiment, the stop device 87 is made from 16 gauge stainless steel sheet with the tubular section 110 made of one half inch outer diameter stainless steel tubing having an internal diameter of 0.37 inch. In this preferred embodiment, the width W of each finger is 0.2 inch while the distance S between the center lines of the fingers is 0.58 inch.

Turning now to the plunger mechanism 50 which is used to temporarily engage one of the pills or tablets in each chute so as to prevent downward movement of this pill or tablet and all of the aligned pills or tablets located about the engaged one, the plunger mechanism 50 is preferably operated by air under pressure from a pressurized air source (not shown). This can be the same source as that used to operate the cylinder 124. This air source is connected to an air cylinder 140 which is connected to one side of mounting or bridge plate 142 by means of bolts 143. Opposite ends of the plate 142 are connected by two connecting rods 144 having threaded ends. One end of each rod extends through the plate 142 and threaded onto this end is a nut 146. The opposite end of each rod can be threadedly connected to a respective edge section of the chute member 56 by screwing the connecting rod into a threaded opening formed in the edge section. A spacer sleeve 147 extends over each rod between the plate 142 and an edge section of the plate 70 in order to maintain the proper distance between the plate 142 and the chute member. The air cylinder 140 (which can be of known construction) has mounted therein two piston members 150 which are detachably connected to a movable plunger support plate 152 by means of threaded ends 153*a* and connecting nuts 153*b* attached thereto. The preferred plunger mechanism includes a number of plunger members 154 only one of which can be seen in FIGS. 2 and 5 and each of these plunger members is slidable in a hole in the plate 152. These plunger members, which are spaced apart and aligned in a row that extends transversely of the chutes, are arranged so that there is one plunger member mounted above each of the chutes for movement towards and away from its respective chute. Each of these plunger members has its own pill engaging end 156 that it made of soft rubber or rubber-like material. It will be appreciated that this pill engaging end extends through a small opening 157 formed in the plate 70 so that the end will be able to contact a pill or tablet in its respective chute 14. Also mounted on each plunger member 154 is a mounting nut or sleeve member 160 on which the soft rubber end is mounted. This nut or sleeve member and its plunger member are biased downwardly by a coil spring 164 which extends around the plunger member. The spring extends between a bottom side of the support plate 152 and the nut member 160. Downward movement of each plunger member 154 is limited by a stop nut 155 threaded onto an upper end of the plunger member. An opening 157' is formed centrally between guide blocks 151 to permit upward movement of the inner nuts 155 and their plunger members as shown in FIG. 5. Guide passages 159 are formed in the blocks 151 in order to guide and support the movement of the two piston members 150. The numbers of piston members 150 can vary from as few as one to as many as four or more. The block or blocks 151 are rigid extensions of the air cylinder member 140. It will be appreciated that the coil spring 164 acts to bias the pill engaging end of the plunder towards the tablet engaging position so as to provide a soft engagement between the tablet engaging end 156 of the plunger mechanism and the tablet.

During use of this feeding apparatus 12, the bottom pill or tablet in the row is located downstream of the plunger mechanism 50. The stop device 87 moves to a pill releasing position when the plunger members are engaging respective pills or tablets in their respective chutes, each engaged pill or tablet being located directly above the bottom pill in the chute. The stop device 87 moves to this releasing position when the feed roll has rotated to a position where it can receive the bottom pill in an empty one of the cavities 81. However, the stop device 87 will act to prevent downward movement of the row of pills in each chute past the stop device when the plunger mechanism 50 is moved to a position of disengagement from any pills in the chutes. A suitable microprocessor can be used to properly time the operation of air valves (not shown), that control the air cylinders 124 and 140, so that the tablets are released and/or held at the proper times.

Instead of using two air cylinders operated by air valves and a microprocessor to hold and release the tablets in the chutes as required, it is also possible to use two cam members and cam followers with the cam members being mounted on one end of the feed roller 52. The cam follower in the form of a wheel or roller mounted on a pivoting arm is biased to engage with its respective rotating cam. The arm is pivotably connected to the plunger support plate 152 and is capable of moving this plate inwardly or outwardly towards or away from the chutes when and as required so the pills above the bottom pills of the chutes will be held in place when the bottom pills are released by the stop member. In a somewhat similar manner another cam follower in the form of a wheel or roller is mounted on another pivoting arm and is biased to engage the circumference of the other cam member as it rotates. This arm member is pivotably connected to the stop device 87 and again operates to move the fingers into and out of the channels so as to hold the bottom pills and to release the bottom pills when required. It will be appreciated by those skilled in the art that this mechanical, cam system for moving the plunger members and the stop member can have some advantages and may, for example, be less expensive to manufacture than the feeding apparatus employing air cylinders, air valves and a microprocessor. It will be appreciated that various modifications and changes can be made to the described feeding apparatus without departing from the spirit and scope of this invention. Accordingly, all such modifications and changes as fall within the scope of the appended claims are intended to be within the scope of this invention.

I claim:

1. An apparatus for delivering pills and encapsulating pills with a gelatin layer, said apparatus comprising:

at least one elongate pill chute or each chute capable of holding a number of pills aligned in a row along the respective chute and capable of feeding said pills by force of gravity to a moving web of gelatin;

a plunger mechanism capable of temporarily engaging one of said pills in the or each chute so as to prevent downward movement of said one pill and all aligned pills located above said one pill in the respective chute;

a rotatable feed roll with a circular circumference located adjacent a bottom end section of said at least one pill chute, said feed roll having a number of pill cavities each capable of holding an individual pill, said cavities being distributed around the circumference of the feed roll;

stop means for preventing temporarily downward movement of a bottom pill of the row of pills in the or each chute, said bottom pill being located downstream of said plunger mechanism, said stop means moving to a pill releasing position when said plunger mechanism is engaging one of said pills in the respective chute, the engaged pill being located directly above said bottom pill in the chute, and when said feed roll has rotated to a position where it can receive said bottom pill in an empty one of said cavities;

wherein said stop means prevents downward movement of the row of pills in the or each chute past said stop means when said plunger mechanism is moved to a position of disengagement from any pill in the chute or chutes; and die members receiving webs of gelatin onto which rows of pills are positioned, said die members cooperating to encapsulate individual pills.

2. The apparatus according to claim 1 wherein there are a number of pill chutes arranged in side-by-side fashion and said feed roll is generally cylindrical in shape and has a number of circumferential rows of pill cavities.

3. The apparatus according to claim 2 including drive means for rotating said feed roll on a continuous basis during operation of said machine.

4. The apparatus according to claim 2 wherein said stop means includes a pivotable stop device having a number of spaced-apart fingers arranged in a row in a side-by-side manner and said fingers can be pivoted from a movement preventing position where each finger projects into a respective one of said chutes to the pill position where the fingers are located away from paths of movement of said pills down and along said chutes.

5. A feeding apparatus for delivering pills to a machine for encapsulating or covering said pills with a layer of protective material, said apparatus comprising:

at least one elongate pill chute or each chute capable of holding a number of pills aligned in a row along the respective chute and capable of feeding said pills by force of gravity to a moving web of said protective material;

a plunger mechanism capable of temporarily engaging one of said pills in the or each chute so as to prevent downward movement of said one pill and all aligned pills located above said one pill in the respective chute;

a rotatable feed roll with a circular circumference located adjacent a bottom end section of said at least one pill chute, said feed roll having a number of pill cavities each capable of holding an individual pill, said cavities being distributed around the circumference of the feed roll, wherein said feed roll is coated with tetrafluoroethylene polymer about its circumference;

stop means for preventing temporarily downward movement of a bottom pill of the row of pills in the or each chute, said bottom pill being located downstream of said plunger mechanism, said stop means moving to a pill releasing position when said plunger mechanism is engaged one of said pills in the respective chute, the engaged pill being located directly above said bottom pill in the chute, and when said feed roll has rotated to a position where it can receive said bottom pill in an empty one of said cavities; and wherein said stop means prevents downward movement of the row of pills in the or each chute past said stop means when said plunger mechanism is moved to a position of disengagement from any pill in the chute or chutes.

6. A feeding apparatus for delivering pills to a machine for encapsulating or covering said pills with a layer of protective material, said apparatus comprising:

at least one elongate pill chute or each chute capable of holding a number of pills aligned in a row along the respective chute and capable of feeding said pills by force of gravity to a moving web of said protective material;

a plunger mechanism capable of temporarily engaging one of said pills in the or each chute so as to prevent downward movement of said one pill and all aligned pills located above said one pill in the respective chute, wherein said plunger mechanism is operated by air under pressure and has a pill engaging end made of a soft rubber or rubberlike material;

a rotatable feed roll with a circular circumference located adjacent a bottom end section of said at least one pill chute, said feed roll having a number of pill cavities each capable of holding an individual pill, said cavities being distributed around the circumference of the feed roll, wherein there are a number of pill chutes arranged in side-by-side fashion and said feed roll is generally cylindrical in shape and has a number of circumferential rows of pill cavities;

stop means for preventing temporarily downward movement of a bottom pill of the row of pills in the or each chute, said bottom pill being located downstream of said plunger mechanism, said stop means moving to a pill releasing position when said plunger mechanism is engaging one of said pills in the respective chute, the engaged pill being located directly above said bottom pill in the chute, and when said feed roll has rotated to a position where it can receive said bottom pill in an empty one of said cavities; and wherein said stop means prevents downward movement of the row of pills in the or each chute past said stop means when said plunger mechanism is moved to a position of disengagement from any pill in the chute or chutes.

7. A feeding apparatus according to claim 6 wherein said plunger mechanism includes a number of plunger members and each of said plunger members is mounted above a respective one of said chutes for movement towards and away from its respective chute, each of said plunger members having its own pill engaging end made of soft rubber or rubberlike material.

8. A feeding apparatus for delivering pills to a machine for encapsulating or covering said pills with a layer of protective material, said apparatus comprising:

at least one elongate pill chute or each chute capable of holding a number of pills aligned in a row along the respective chute and capable of feeding said pills by force of gravity to a moving web of said protective material;

a plunger mechanism capable of temporarily engaging one of said pills in the or each chute so as to prevent downward movement of said one pill and all aligned pills located above said one pill in the respective chute;

a rotatable feed roll with a circular circumference located adjacent a bottom end section of said at least one pill chute, said feed roll having a number of pill cavities each capable of holding an individual pill, said cavities being distributed around the circumference of the feed roll, wherein there are a number of pill chutes arranged in side-by-side fashion and said feed roll is generally cylindrical in shape and has a number of circumferential rows of pill cavities, and wherein said feed roll is coated with pharmaceutical grade tetrafluoroethylene polymer about its circumference;

stop means for preventing temporarily downward movement of a bottom pill of the row of pills in the or each chute, said bottom pill being located downstream of said plunger mechanism, said stop means moving to a pill releasing position when said plunger mechanism is engaging one of said pills in the respective chute, the engaged pill being located directly above said bottom pill in the chute, and when said feed roll has rotated to a position where it can receive said bottom pill in an empty one of said cavities, wherein said stop means includes a pivotable stop device having a number of spaced-apart fingers arranged in a row in a side-by-side manner and said fingers can be pivoted from a movement preventing position where each finger projects into a respective one of said chutes to the pill position where the fingers are located away from paths of movement of said pills down and along said chutes; and wherein said stop means prevents downward movement of the row of pills in the or each chute past said stop means when said plunger mechanism is moved to a position of disengagement from any pill in the chute or chutes.

9. A feeding apparatus according to claim 8 wherein said pill cavities are of uniform size and each has a circumferential dimension and an axial dimension corresponding closely to length and width dimensions of each pill to be encapsulated or covered by said machine.

10. A feeding apparatus according to claim 9 wherein said pill cavities each have a depth that is approximately the same as one-half the depth of each pill to be encapsulated or covered by said machine.

11. A tablet feeding apparatus for delivering tablets to a moving web of a covering material, said apparatus comprising:

two or more chutes each sized to hold and transfer a number of tablets arranged in a row along the chute by force of gravity, said chutes extending vertically during use thereof;

contact means for temporarily engaging one of said tablets in each chute so as to prevent downward movement of said one tablet and all tablets located above said one tablet in the respective chute;

a rotatable feed roll located adjacent a bottom end section of said chutes, said feed roll having a number of tablet cavities each capable of holding an individual tablet, said cavities being distributed around the circumference of said feed roll and forming one circumferential row of cavities for each chute, wherein said feed roll is coated with tetrafluoroethylene polymer about its circumference;

a movable stop member of each of said chutes for providing a timed release of a bottom tablet in the respective chute, said bottom tablet being located downstream of said contract means, each stop member being moved to a stopping position when said contact means is disengaged from any tablet in its respective chute and being moved to a releasing position when said contact means is engaging said one tablet in its respective chute; and a drive device for moving each stop member between said stopping position and said releasing position in a timed manner so that each bottom tablet is only released when said feed roll is rotated to a position where it can receive the bottom pill in an empty one of said cavities.

12. A tablet feeding apparatus according to claim 11 wherein said contact means includes two or more plungers, one for each of the chutes and air pressure operated drive means for moving said plungers from a tablet engaging position to a retracted position of non-engagement.

13. A tablet feeding apparatus according to claim 12 wherein each plunger is biased by a coil spring towards said tablet engaging position so as to provide a soft engagement between a tablet engaging end of the plunger and the one tablet.

14. A tablet feeding apparatus according to claim 13 wherein said tablet engaging end is made of soft rubber or rubberlike material and the stop members are fingers pivotable between said stopping position where they extend into chutes and said releasing position where they are swung out of said chutes.

15. An apparatus for use in the manufacture of pills, said apparatus comprising:

a chute adapted to hold and transfer a row of tablets arranged along said chute, said chute extending vertically during use thereof;

a rotatable feed roll for moving said tablets from a bottom end of said chute onto a top surface of a single moving web of gelatin, said feed roll being located adjacent a bottom end section of said chute and having a number of tablet cavities each capable of holding an individual tablet, said cavities being distributed about the circumference of said feed roll;

a timed tablet holding and releasing mechanism capable of releasing a bottom tablet in the chute so that it can descend by force of gravity into an empty one of said cavities while holding back other tablets in said chute, said releasing mechanism including a movable holding member for temporarily preventing all tablets located above said bottom tablet in the chute from descending in said chute when said bottom tablet is released; and a pair of dies and gelatin web supply rollers cooperating with said dies for encapsulating individual tablets with gelatin.

16. A tablet feeding apparatus for use in the manufacture of pills, said apparatus comprising:

a chute adapted to hold and transfer a row of tablets arranged along said chute, said chute extending vertically during use thereof;

a rotatable feed roll for moving said tablets from a bottom end of said chute onto a top surface of a single moving web of material, said feed roll being located adjacent a bottom end section of said chute and having a number of tablet cavities each capable of holding an individual tablet, said cavities being distributed about the circumference of said feed roll, wherein said feed roll is coated with tetrafluoroethylene polymer; and a timed tablet holding and releasing mechanism capable of releasing a bottom tablet in the chute so that it can descend by force of gravity into an empty one of said cavities while holding back other tablets in said chute, said releasing mechanism including a movable holding member for temporarily preventing all tablets located above said bottom tablet in the chute from descending in said chute when said bottom tablet is released.

17. The apparatus according to claim 15 wherein said chute extends along a steeply inclined slope for a major portion of its length and said bottom end section forms an arc which is concave generally upwardly, this arc closely following a circumferential section of said feed roll.

18. The apparatus according to claim 15 wherein said timed tablet holding and releasing mechanism includes a pivotable stop member for preventing temporarily downward movement of said bottom tablet in said chute and drive means for pivoting said stop member in a timed manner between a stop position where said stop member extends into said chute and a release position where said stop member is moved out of said chute.

19. A tablet feeding apparatus for use in the manufacture of pills, said apparatus comprising:

a chute adapted to hold and transfer a row of tablets arranged along said chute, said chute extending vertically during use thereof;

a rotatable feed roll for moving said tablets from a bottom end of said chute onto a top surface of a single moving web of material, said feed roll being located adjacent a bottom end section of said chute and having a number of tablet cavities each capable of holding an individual tablet, said cavities being distributed about the circumference of said feed roll; and a timed tablet holding and releasing mechanism capable of releasing a bottom tablet in the chute so that it can descend by force of gravity into an empty one of said cavities while holding back other tablets in said chute, said releasing mechanism including a movable holding member for temporarily preventing all tablets located above said bottom tablet in the chute from descending in said chute when said bottom tablet is released, wherein said timed tablet holding and releasing mechanism includes a pivotable stop member for preventing temporarily downward movement of said bottom tablet in said chute and drive means for pivoting said stop member in a timed manner between a stop position where said stop member extends into said chute and a release position where said stop member is moved out of said chute, and wherein said feed roll is coated with a tetrafluoroethylene polymer and said drive means comprises an air pressure operated piston and cylinder drive device in which a piston member is slidably movable in a cylinder of the drive device, an outer end of said piston member being connected to said pivotable stop member.

20. A tablet feeding apparatus for use in the manufacture of pills, said apparatus comprising:

a chute adapted to hold and transfer a row of tablets arranged along said chute, said chute extending vertically during use thereof;

a rotatable feed roll for moving said tablets from a bottom end of said chute onto a top surface of a single moving web of material, said feed roll being located adjacent a bottom end section of said chute and having a number of tablet cavities each capable of holding an individual tablet, said cavities being distributed about the circumference of said feed roll; and a timed tablet holding and releasing mechanism capable of releasing a bottom tablet in the chute so that it can descend by force of gravity into an empty one of said cavities while holding back other tablets in said chute, said releasing mechanism including a movable holding member for temporarily preventing all tablets located above said bottom tablet in the chute from descending in said chute when said bottom tablet is released, wherein said movable holding member includes a plunger and said holding and releasing mechanism includes air pressure operated drive means for moving said plunger between a tablet engaging position and a retracted position, and wherein said plunger has a tablet engaging end made of soft rubber or rubber like material.

21. A tablet feeding apparatus according to claim 20 wherein said holding and releasing mechanism further includes a coil spring mounted on said plunger and mounted so as to bias said tablet engaging end towards a tablet in the chute.

* * * * *